US011311897B2

(12) United States Patent
Wang et al.

(10) Patent No.: US 11,311,897 B2
(45) Date of Patent: Apr. 26, 2022

(54) ANTI-SPLASH WATER OUTFLOW DEVICE

(71) Applicant: Xiamen Lota International Co., Ltd., Fujian (CN)

(72) Inventors: Xuedong Wang, Fujian (CN); Jiangcheng Zhang, Fujian (CN); Zhixin Lin, Fujian (CN); Chuanbao Zhu, Fujian (CN)

(73) Assignee: Xiamen Lota International Co., Ltd., Xiamen (CN)

( * ) Notice: Subject to any disclaimer, the term of this patent is extended or adjusted under 35 U.S.C. 154(b) by 0 days.

(21) Appl. No.: 16/914,820

(22) Filed: Jun. 29, 2020

(65) Prior Publication Data

US 2020/0406276 A1 Dec. 31, 2020

(30) Foreign Application Priority Data

Jun. 28, 2019 (CN) ..... 201910577141.2

(51) Int. Cl.

| | |
|---|---|
| ***B05B 3/04*** | (2006.01) |
| ***B05B 1/02*** | (2006.01) |
| ***B05B 1/26*** | (2006.01) |
| ***B05B 1/34*** | (2006.01) |

(52) U.S. Cl.

CPC ..... *B05B 3/0486* (2013.01); *B05B 1/02* (2013.01); *B05B 1/26* (2013.01); *B05B 1/341* (2013.01)

(58) Field of Classification Search

CPC ..... B05B 3/0486; B05B 1/02; B05B 1/26; B05B 1/341

USPC ..... 239/383, 501

See application file for complete search history.

(56) References Cited

U.S. PATENT DOCUMENTS 473,759 A * 4/1892 Klein
7,066,407 B2 * 6/2006 Lu ..... B05B 3/0486 239/104

FOREIGN PATENT DOCUMENTS

CN 205995645 U 3/2017

* cited by examiner

*Primary Examiner* — Christopher S Kim
(74) *Attorney, Agent, or Firm* — Cooper Legal Group, LLC

(57) ABSTRACT

The present disclosure discloses an anti-splash water outflow device comprises a water outflow body and an internal assembly. The internal assembly comprises an inner body that is rotatable relative to the water outflow body upon being impacted by water. The inner body is disposed with at least two spiral blades, and two adjacent spiral blades of the at least two spiral blades define a spiral water passage. The water flows into the water outflow body from the water inlet to impact the inner body to drive the inner body to rotate relative to the water outflow body, and the water flows through the spiral water passage, flows out of the outlet of the spiral water passage, flows spirally downward along an inner wall surface of the water outflow body, and sprays out of the water outlet to obtain an annular water spray shaped as a lampshade.

10 Claims, 7 Drawing Sheets

ANTI-SPLASH WATER OUTFLOW DEVICE

RELATED APPLICATION

This application claims priority to Chinese Patent Application 201910577141.2, filed on Jun. 28, 2019. Chinese Patent Application 201910577141.2 is incorporated herein by reference.

FIELD OF THE DISCLOSURE

The present disclosure relates to an anti-splash water outflow device.

BACKGROUND OF THE DISCLOSURE

In existing water outflow devices, such as kitchen faucets, showers, and top spray showers, water with a high pressure easily splashes, and an end-user experience is poor.

Attempts have been made to address this issue. For example, Chinese utility model patent CN205995645U discloses an anti-splash water curtain structure. The anti-splash water curtain structure comprises an inner core, and an outer surface of the inner core is coupled to an inner wall surface of a body of the anti-splash water curtain structure to define a gap, resulting in annular shaped water flowing out of a water outlet. However, an anti-splash effect of the annular shaped water outflow is not good, and the water still splashes.

BRIEF SUMMARY OF THE DISCLOSURE

The present disclosure provides an anti-splash water outflow device, which overcomes the deficiencies of existing techniques. In order to solve the aforementioned technical problems, a technical solution of the present disclosure is as follows.

An anti-splash water outflow device comprises a water outflow body comprising a water inlet and a water outlet and an internal assembly disposed in the water outflow body. The internal assembly comprises an inner body that is rotatable relative to the water outflow body upon being impacted by water. The inner body is disposed with at least two spiral blades, and two adjacent spiral blades of the at least two spiral blades define a spiral water passage. An inlet of the spiral water passage is in communication with the water inlet, and an outlet of the spiral water passage is in communication with the water outlet. The water flows into the water outflow body from the water inlet to impact the inner body to drive the inner body to rotate relative to the water outflow body, and the water flows through the spiral water passage, flows out of the outlet of the spiral water passage, flows spirally downward along an inner wall surface of the water outflow body, and sprays out of the water outlet to obtain an annular water spray shaped as a lampshade.

In a preferred embodiment, the outlet of the spiral water passage and the water outlet of the water outflow body define a first gap.

In a preferred embodiment, the internal assembly further comprises a connecting body. The connecting body is connected to the water outflow body, and the inner body movably surrounds an outside of the connecting body.

In a preferred embodiment, a partition board is disposed in the water outflow body, and the connecting body is disposed on the partition board.

In a preferred embodiment, the partition board extends upward to define a protruding column, and the protruding column comprises a through hole. An outer periphery of the connecting body comprises a first protruding platform and a step surface disposed at intervals. The connecting body extends out of the through hole, the first protruding platform abuts a top end of the protruding column, and the step surface abuts a bottom end surface of the partition board.

In a preferred embodiment, the outer periphery of the connecting body further comprises a second protruding platform, and the inner body abuts the second protruding platform and is disposed below the partition board.

In a preferred embodiment, the outer periphery of the connecting body further comprises a groove, and a sealing member is disposed between the groove and an inner wall of the through hole.

In a preferred embodiment, the connecting body comprises a strong water passage configured to be in communication with the water inlet and the water outlet, and the spiral water passage surrounds the strong water passage.

In a preferred embodiment, the partition board comprises a slanted water hole passing through the partition board. An inlet of the slanted water hole is in communication with the water inlet, and an outlet of the slanted water hole corresponds to the inlet.

Compared with existing techniques, the technical solution of the present disclosure has the following advantages.

1. Water flows from the water inlet into the water outflow body and impacts the inner body to drive the inner body to rotate relative to the water outflow body, and the water flows through the spiral water passage, flows out of the outlet of the spiral water passage, flows spirally downward along the inner wall of the water outflow body, and sprays out of the water outlet to obtain the annular water spray shaped as a lampshade. After the water flows out of the spiral water passage, the inner body rotates to enable the water to continue to rotate along the inner wall surface of the water outflow body until the water flows out of the water outlet. The water still rotates at the water outlet to enable the water flowing out of the water outlet to define the annular water spray shaped as the lampshade that is larger than a size of the water outflow body. The annular water spray has good continuity, a beautiful appearance, moderate strength, and does not splash. At the same time, the annular water spray can cover splashing of strong water disposed in the annular water spray to achieve an anti-splash function.

2. The outlet of the spiral water passage and the water outlet of the water outflow body define a first gap. The first gap is configured to enable the water flowing out of the outlet of the spiral water passage to continue to rotate along the inner wall of the water outflow body to form the annular water spray shaped as the lampshade.

3. The connecting body extends out of the through hole, the first protruding platform abuts the top end of the protruding column, and the step surface abuts the bottom end surface of the partition board. The first protruding platform cooperates with the protruding column, and the step surface cooperates with the partition board to enable an axial positioning of the connecting body.

4. The inner body surrounds an outside of the connecting body, abuts the second protruding platform, and is disposed below the partition board. The inner body is positioned between the partition board and the second protruding platform, and the inner body is rotatably connected to the connecting body.

BRIEF DESCRIPTION OF THE DRAWINGS

The present disclosure will be further described below with reference to the drawings and embodiments.

DETAILED DESCRIPTION OF THE EMBODIMENTS

Figure 1:
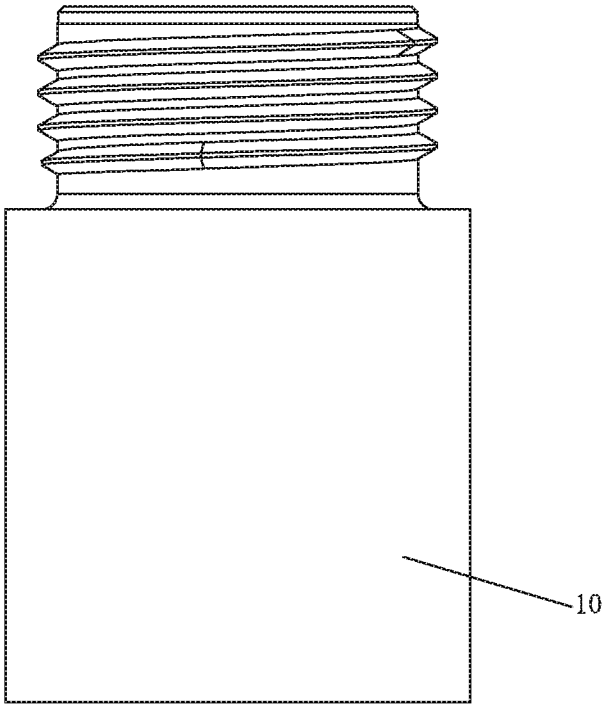
FIG. 1 illustrates an exterior view of an anti-splash water outflow device.
Figure 2:
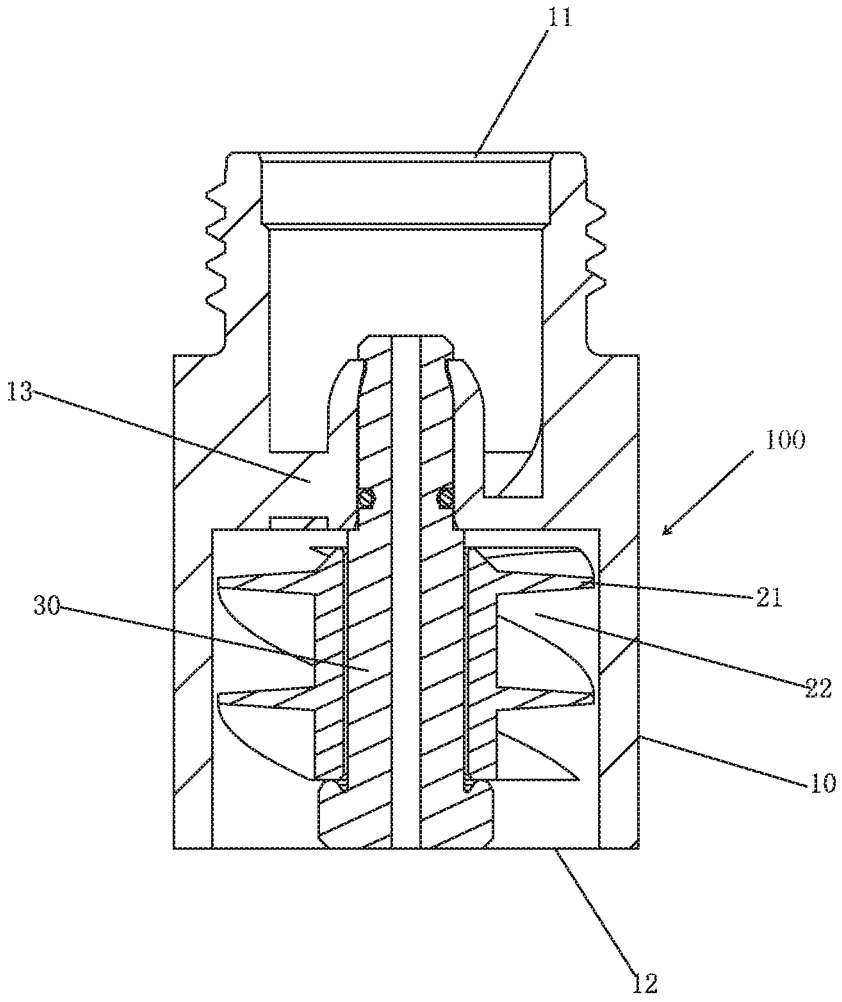
FIG. 2 illustrates a cross-sectional view of the anti-splash water outflow device.
Figure 3:
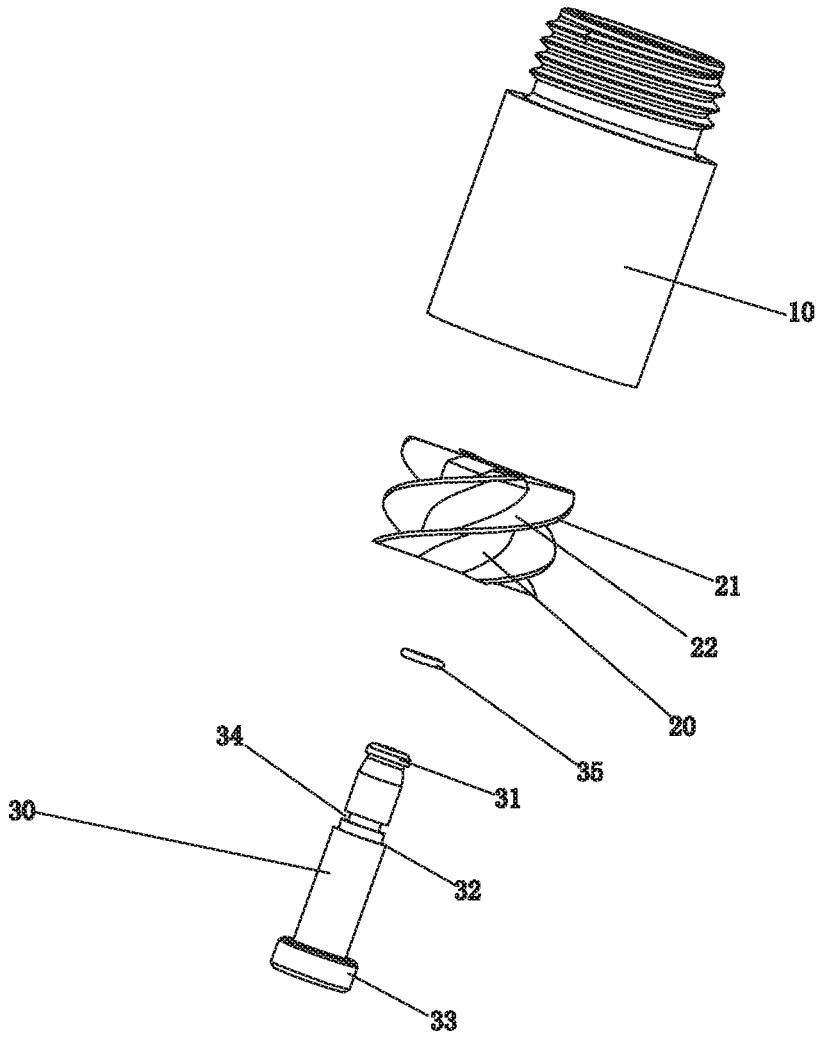
FIG. 3 illustrates an exploded perspective view of the anti-splash water outflow device.

Referring to FIGS. 1-7, an anti-splash water outflow device comprises a water outflow body 10 and an internal assembly 100.

The water outflow body 10 comprises a water inlet 11 and a water outlet 12.

The internal assembly 100 is disposed in the water outflow body 10. The internal assembly 100 comprises an inner body 20 that is rotatable relative to the water outflow body 10 due to an impact force of water. The inner body 20 is disposed with at least two spiral blades 21, and two adjacent spiral blades 21 of the at least two spiral blades 21 define a spiral water passage 22. An inlet of the spiral water passage 22 is in communication with the water inlet 11, and an outlet of the spiral water passage 22 is in communication with the water outlet 12. The water flows into the water outflow body 10 from the water inlet 11 to impact the inner body 20 to drive the inner body 20 to rotate relative to the water outflow body 10. T the water flows through the spiral water passage 22, flows out of the outlet thereof, flows spirally downward along an inner wall of the water outflow body 10, and sprays out of the water outlet 12 to obtain an annular water spray shaped as a lampshade (e.g., a hollow cone).

Figure 4:
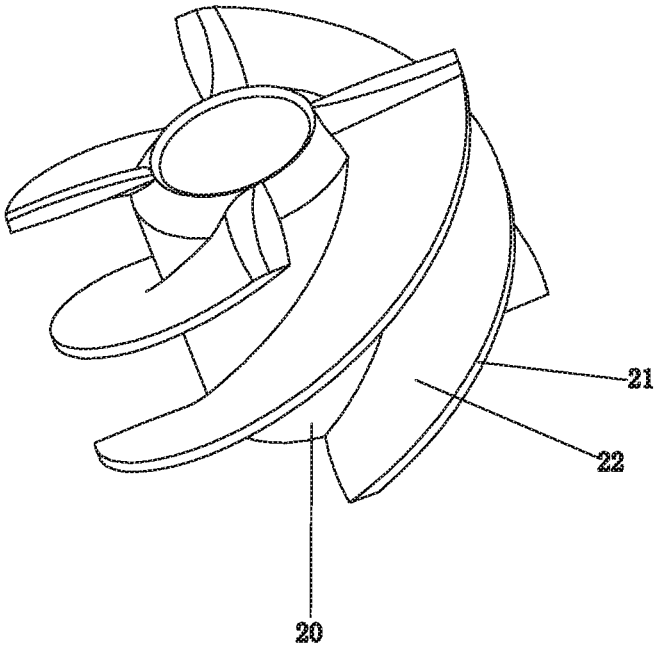
FIG. 4 illustrates a perspective view of an inner body.

Referring to FIG. 4, the at least two spiral blades 21 comprise four spiral blades 21 annularly disposed at intervals to define four spiral water passages 22.

In this embodiment, the outlets of the four spiral water passages 22 and the water outlet 12 of the water outflow body 10 define a first gap D, and the first gap D corresponds to a size of the water outflow body 10. When the water outflow body 10 is larger, the first gap D is larger. When the water outflow body 10 is smaller, the first gap D is smaller. The size of the first gap D can be anything as long as the annular water spray shaped as the lampshade in FIG. 7 can be obtained.

In this embodiment, the internal assembly 100 further comprises a connecting body 30. The connecting body 30 is connected to the water outflow body 10, and the inner body 20 movably surrounds an outside of the connecting body 30.

In this embodiment, a partition board 13 is disposed in the water outflow body 10, and the connecting body 30 is disposed on the partition board 13.

Figure 5:
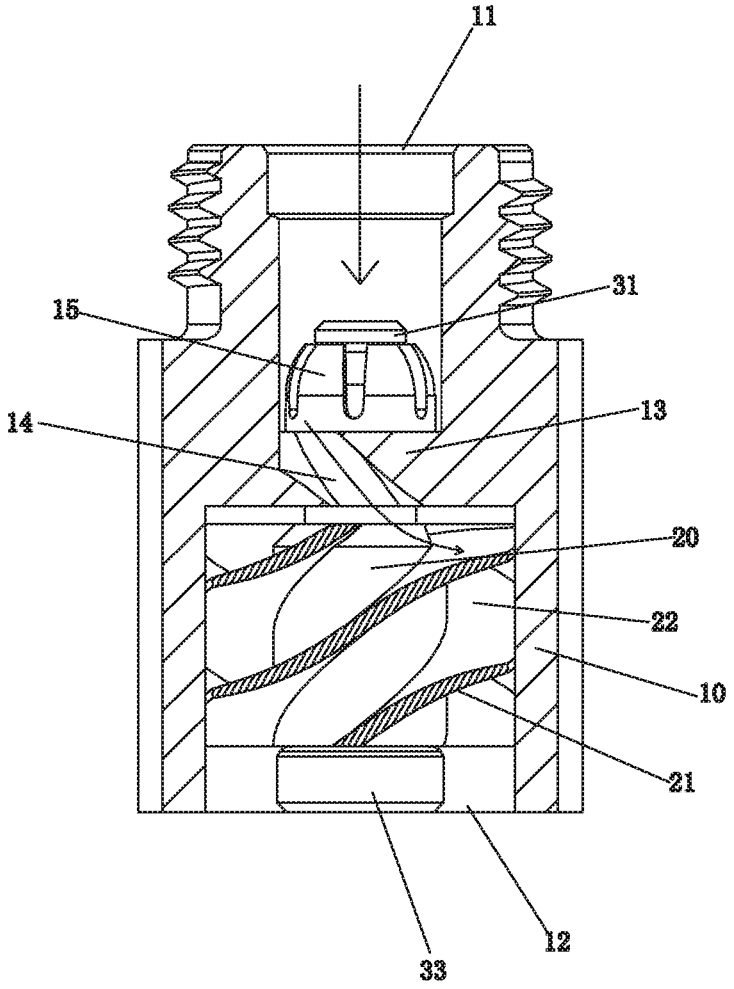
FIG. 5 illustrates a cross-sectional view of the anti-splash water outflow device when water enters a spiral water passage from a slanted water hole.

In this embodiment, the partition board 13 comprises a slanted water hole 14 passing through the partition board 13. Referring to FIG. 5, an inlet of the slanted water hole 14 is in communication with the water inlet 11, and an outlet of the slanted water hole 14 corresponds to the inlet of the four spiral water passages 22 and faces top ends of the four spiral blades 21. The slanted water hole 14 enables the inner body 20 to rotate more quickly.

In this embodiment, the partition board 13 extends upward to define a protruding column 15, and the protruding column 15 comprises a through hole 151. An outer periphery of the connecting body 30 comprises a first protruding platform 31 and a step surface 32 disposed at intervals. The connecting body 30 extends out of the through hole 151. The first protruding platform 31 abuts a top end of the protruding column 15, and the step surface 32 abuts a bottom end surface of the partition board 13.

In this embodiment, the outer periphery of the connecting body 30 further comprises a second protruding platform 33. The inner body 20 surrounds the outside of the connecting body 30, abuts the second protruding platform 33, and is disposed below the partition board 13.

In this embodiment, the outer periphery of the connecting body 30 further comprises a groove 34, and a sealing member 35 is disposed between the groove 34 and an inner wall of the through hole 151.

Figure 7:
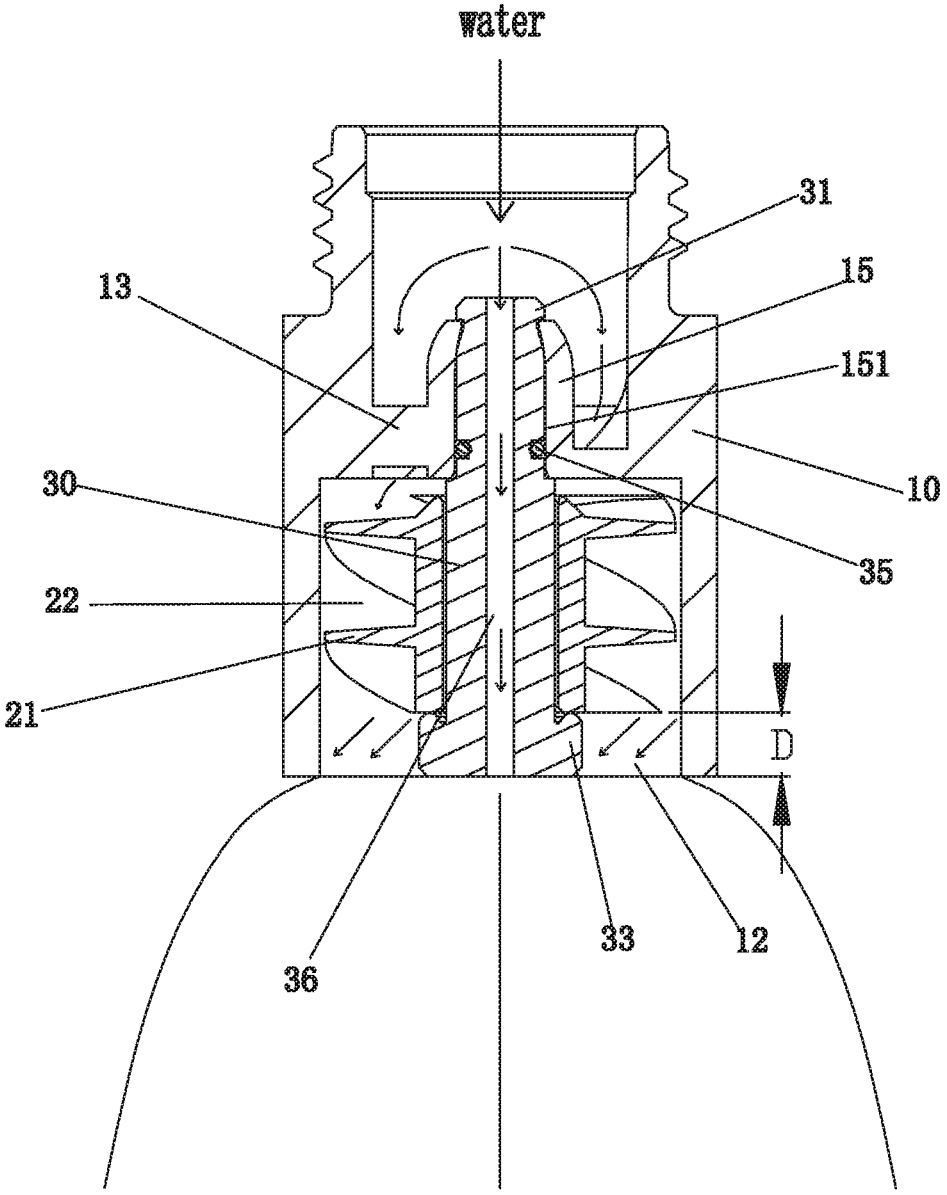
FIG. 7 illustrates a cross-sectional view of the anti-splash water outflow device when the water flows out of the anti-splash water outflow device.

In this embodiment, the connecting body 30 comprises a strong water passage 36 configured to be in communication with both the water inlet 11 and the water outlet 12, and the four spiral passages 22 surround the strong water passage 36. Referring to FIG. 7, an outlet of the strong water passage 36 and the water outlet 12 of the water outflow body 10 are on a same horizontal surface. Alternatively, the outlet of the strong water passage 36 and the water outlet 12 of the water outflow body 10 are staggered as needed. That is, a second gap is disposed between the outlet of the strong water passage 36 and the water outlet 12 of the water outflow body 10. No matter whether the outlet of the strong water passage 36 and the water outlet 12 of the water outflow body 10 are on the same horizontal surface, a water outflow effect of the strong water passage 36 and the water outflow body 10 will not be affected.

A water outflow operation of the anti-splash water outlet device is as follows.

Figure 6:
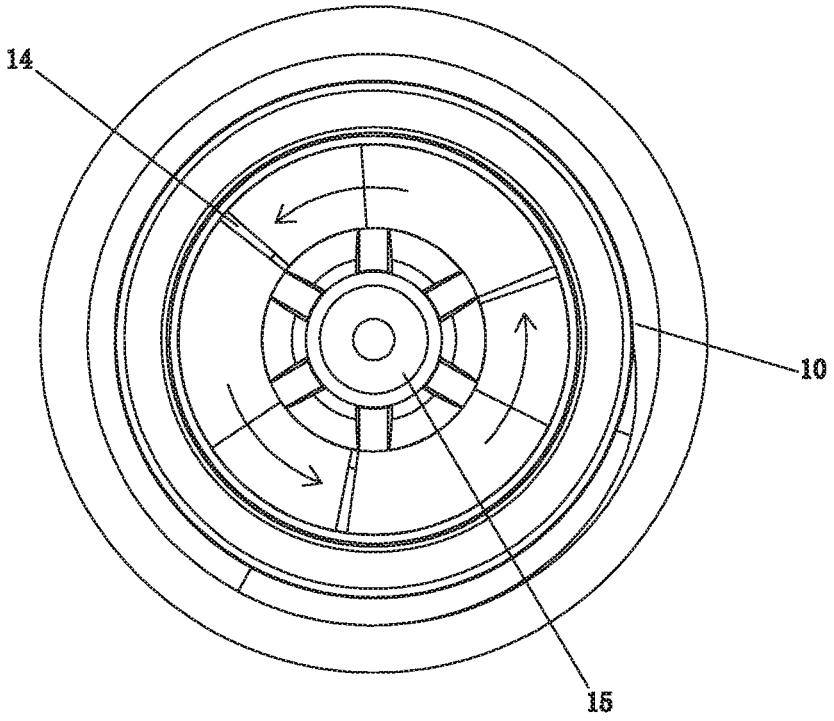
FIG. 6 illustrates a top-down view of the anti-splash water outflow device when the water flows into the slanted water hole.

The water enters the water outflow body 10 from the water inlet 11 of the water outflow body 10. Referring to FIG. 6, a portion of the water flows into the slanted water hole 14. The portion of the water then flows from the outlet of the slanted water hole 14 and into the inlet of the spiral water passage 22. At the same time, the portion of the water drives the inner body 20 to rotate relative to the water outflow body 10. The inner body 20 rotates to drive the portion of the water to spirally flow along the spiral water passage 22, flow out of the outlet of the spiral water passage 22, and then continually spirally flow along the inner wall of the water outflow body 10 due to inertia until the portion of the water flows out of the water outlet 12. Referring to FIG. 7, a size of the annular water spray shaped as the lampshade is larger than a size of the outlet of the water outflow body 10. The rest of the water flows into the strong water passage 36 and directly flows out of the outlet of the strong water passage 36 to obtain strong water with a stronger impact force (e.g., an impact force of the strong water is stronger than an impact force of the annular water spray shaped as the lampshade). When the strong water impacts an object or a person, the strong water creates more of a splash (e.g., the strong water is more easily splashed than the annular water spray shaped as lampshade), and the annular water spray shaped as lampshade can block the splash of the strong water. The splashing water is therefore blocked by the annular water spray to achieve an anti-splash effect.

The anti-splash water outflow device can be installed on any product that needs to discharge water such as, for example, a shower, a top shower head, a shower faucet, a kitchen faucet, a bathtub faucet, and even a water purifier faucet. The product is not limited to installation on a specific type of device.

It will be apparent to those skilled in the art that various modifications and variation can be made in the present disclosure without departing from the spirit or scope of the disclosure. Thus, it is intended that the present disclosure cover the modifications and variations of this disclosure provided they come within the scope of the appended claims and their equivalents.

What is claimed is:

1. An anti-splash water outflow device, comprising:

a water outflow body comprising a water inlet and a water outlet, and an internal assembly disposed in the water outflow body, wherein:

the internal assembly comprises an inner body that is rotatable relative to the water outflow body upon being impacted by water, the inner body is disposed with at least two spiral blades, two spiral blades of the at least two spiral blades define a spiral water passage, an inlet of the spiral water passage is in communication with the water inlet, an outlet of the spiral water passage is in communication with the water outlet, the water flows into the water outflow body from the water inlet to impact the inner body to drive the inner body to rotate relative to the water outflow body, the water flows through the spiral water passage, flows out of the outlet of the spiral water passage, flows spirally downward along an inner wall surface of the water outflow body, and sprays out of the water outlet to obtain an annular water spray shaped as a lampshade, the internal assembly further comprises a connecting body, the connecting body comprises a water passage configured to be in communication with the water inlet and the water outlet, the spiral water passage surrounds the water passage, and when the water flows into the anti-splash water outflow device:

the water from the water inlet flows into the water passage and the inlet of the spiral water passage concurrently, and the inner body and the connecting body rotate synchronously due to the water applied on the at least two spiral blades.

2. The anti-splash water outflow device according to claim 1, wherein the outlet of the spiral water passage and the water outlet of the water outflow body define a first gap.

3. The anti-splash water outflow device according to claim 2, wherein:

the connecting body is connected to the water outflow body, and the inner body movably surrounds an outside of the connecting body.

4. The anti-splash water outflow device according to claim 3, wherein:

a partition board is disposed in the water outflow body, and the connecting body is disposed on the partition board.

5. The anti-splash water outflow device according to claim 4, wherein:

the partition board extends upward to define a protruding column, the protruding column comprises a through hole, an outer periphery of the connecting body comprises a first protruding platform and a step surface disposed at intervals, the connecting body extends out of the through hole, the first protruding platform abuts a top end of the protruding column, and the step surface abuts a bottom end surface of the partition board.

6. The anti-splash water outflow device according to claim 5, wherein:

the outer periphery of the connecting body further comprises a second protruding platform, and the inner body abuts the second protruding platform and is disposed below the partition board.

7. The anti-splash water outflow device according to claim 5, wherein:

the outer periphery of the connecting body further comprises a groove, and a sealing member is disposed between the groove and an inner wall of the through hole.

8. The anti-splash water outflow device according to claim 4, wherein:

the partition board comprises a slanted water hole passing through the partition board, an inlet of the slanted water hole is in communication with the water inlet, and an outlet of the slanted water hole corresponds to the inlet of the spiral water passage.

9. An anti-splash water outflow device, comprising:

a water outflow body comprising a water inlet and a water outlet, and an internal assembly disposed in the water outflow body, wherein:

the internal assembly comprises an inner body that is rotatable relative to the water outflow body upon being impacted by water, the inner body is disposed with at least two spiral blades, two spiral blades of the at least two spiral blades define a spiral water passage, an inlet of the spiral water passage is in communication with the water inlet, an outlet of the spiral water passage is in communication with the water outlet, the water flows into the water outflow body from the water inlet to impact the inner body to drive the inner body to rotate relative to the water outflow body, the water flows through the spiral water passage, flows out of the outlet of the spiral water passage, flows spirally downward along an inner wall surface of the water outflow body, and sprays out of the water outlet to obtain an annular water spray shaped as a lampshade, the outlet of the spiral water passage and the water outlet of the water outflow body define a first gap, the internal assembly further comprises a connecting body, the connecting body is connected to the water outflow body, the inner body movably surrounds an outside of the connecting body, a partition board is disposed in the water outflow body, the connecting body is disposed on the partition board, the partition board extends upward to define a protruding column, the protruding column comprises a through hole, an outer periphery of the connecting body comprises a first protruding platform and a step surface disposed at intervals, the connecting body extends out of the through hole, the first protruding platform abuts a top end of the protruding column, and the step surface abuts a bottom end surface of the partition board.

10. An anti-splash water outflow device, comprising:

a water outflow body comprising a water inlet and a water outlet, and an internal assembly disposed in the water outflow body, wherein:

the internal assembly comprises an inner body that is rotatable relative to the water outflow body upon being impacted by water, the inner body is disposed with at least two spiral blades, two spiral blades of the at least two spiral blades define a spiral water passage, an inlet of the spiral water passage is in communication with the water inlet, an outlet of the spiral water passage is in communication with the water outlet, the water flows into the water outflow body from the water inlet to impact the inner body to drive the inner body to rotate relative to the water outflow body, the water flows through the spiral water passage, flows out of the outlet of the spiral water passage, flows spirally downward along an inner wall surface of the water outflow body, and sprays out of the water outlet to obtain an annular water spray shaped as a lampshade, the outlet of the spiral water passage and the water outlet of the water outflow body define a first gap, the internal assembly further comprises a connecting body, the connecting body is connected to the water outflow body, the inner body movably surrounds an outside of the connecting body, a partition board is disposed in the water outflow body, the connecting body is disposed on the partition board, the partition board comprises a slanted water hole passing through the partition board, an inlet of the slanted water hole is in communication with the water inlet, and an outlet of the slanted water hole corresponds to the inlet of the spiral water passage.

* * * * *